US009874117B2

(12) United States Patent
Oh et al.

(10) Patent No.: US 9,874,117 B2
(45) Date of Patent: Jan. 23, 2018

(54) APPARATUS FOR OPENING AND CLOSING CHANNEL

(71) Applicants: Hyundai Motor Company, Seoul (KR); Kia Motor Corporation, Seoul (KR)

(72) Inventors: Chung Han Oh, Gyeonggi-do (KR); Hyun Kyu Lim, Gyeonggi-do (KR); Yun Seok Kim, Gyeonggi-do (KR); Jong Kuk Park, Gyeonggi-do (KR)

(73) Assignees: Hyundai Motor Company, Seoul (KR); Kia Motor Corporation, Seoul (KR)

( * ) Notice: Subject to any disclaimer, the term of this patent is extended or adjusted under 35 U.S.C. 154(b) by 124 days.

(21) Appl. No.: 14/947,429

(22) Filed: Nov. 20, 2015

(65) Prior Publication Data

US 2016/0376942 A1 Dec. 29, 2016

(30) Foreign Application Priority Data

Jun. 26, 2015 (KR) ..... 10-2015-0091598

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01); *F01L 2001/34433* (2013.01); *F01L 2001/34469* (2013.01)

(58) Field of Classification Search
CPC ..... F01L 1/3442; F01L 2001/34426; F01L 2001/34433; F01L 2001/34469
USPC ..... 123/90.15, 90.17, 90.12
See application file for complete search history.

(56) References Cited

U.S. PATENT DOCUMENTS

2015/0260060 A1* 9/2015 Fischer et al.

FOREIGN PATENT DOCUMENTS

| | | | |
|---|---|---|---|
| JP | 2001241559 | A | 9/2001 |
| JP | 2009115289 | A | 5/2009 |
| KR | 1020090051577 | A | 5/2009 |

OTHER PUBLICATIONS

Korean Office Action dated Apr. 7, 2016.

* cited by examiner

*Primary Examiner* — Ching Chang
(74) *Attorney, Agent, or Firm* — Brinks Gilson & Lione

(57) ABSTRACT

The present disclosure provides generally for an apparatus for opening and closing a channel. A diverter valve may open and close the channel by sliding and having a pressure reducing portion at a side to decrease a side force due to hydraulic pressure.

5 Claims, 3 Drawing Sheets

[ Fig. 1 ]
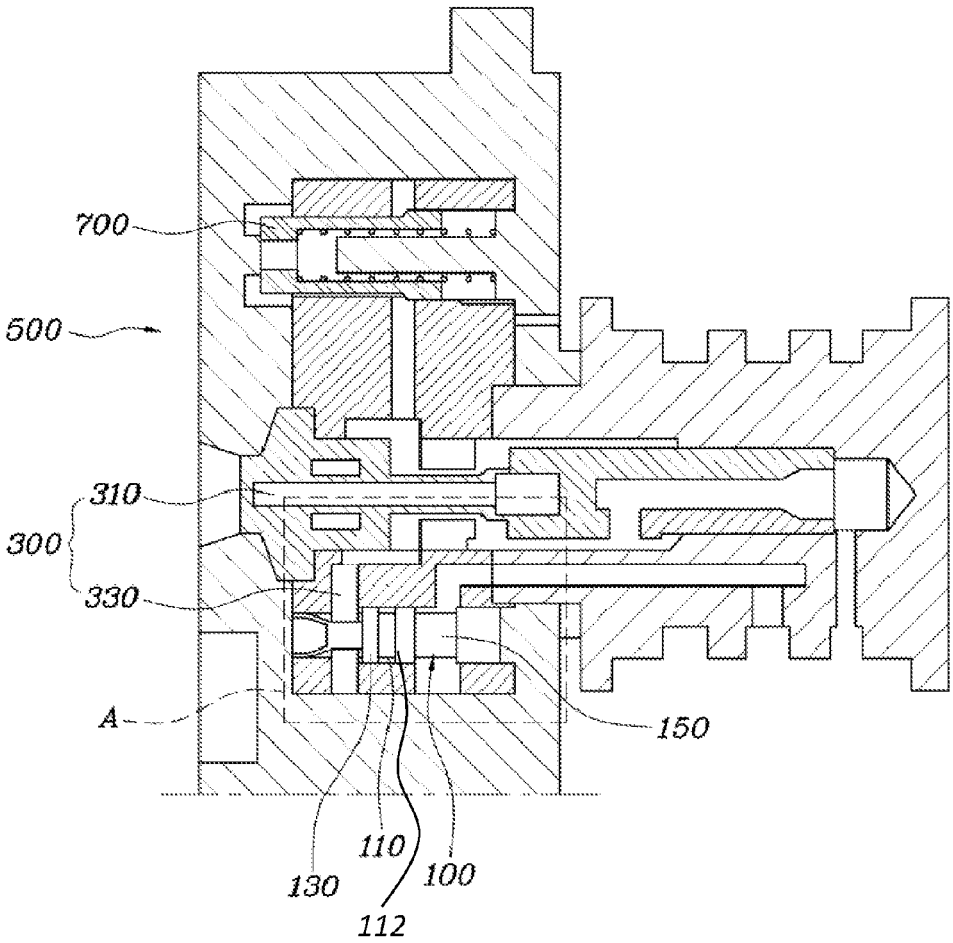

[ Fig. 2 ]
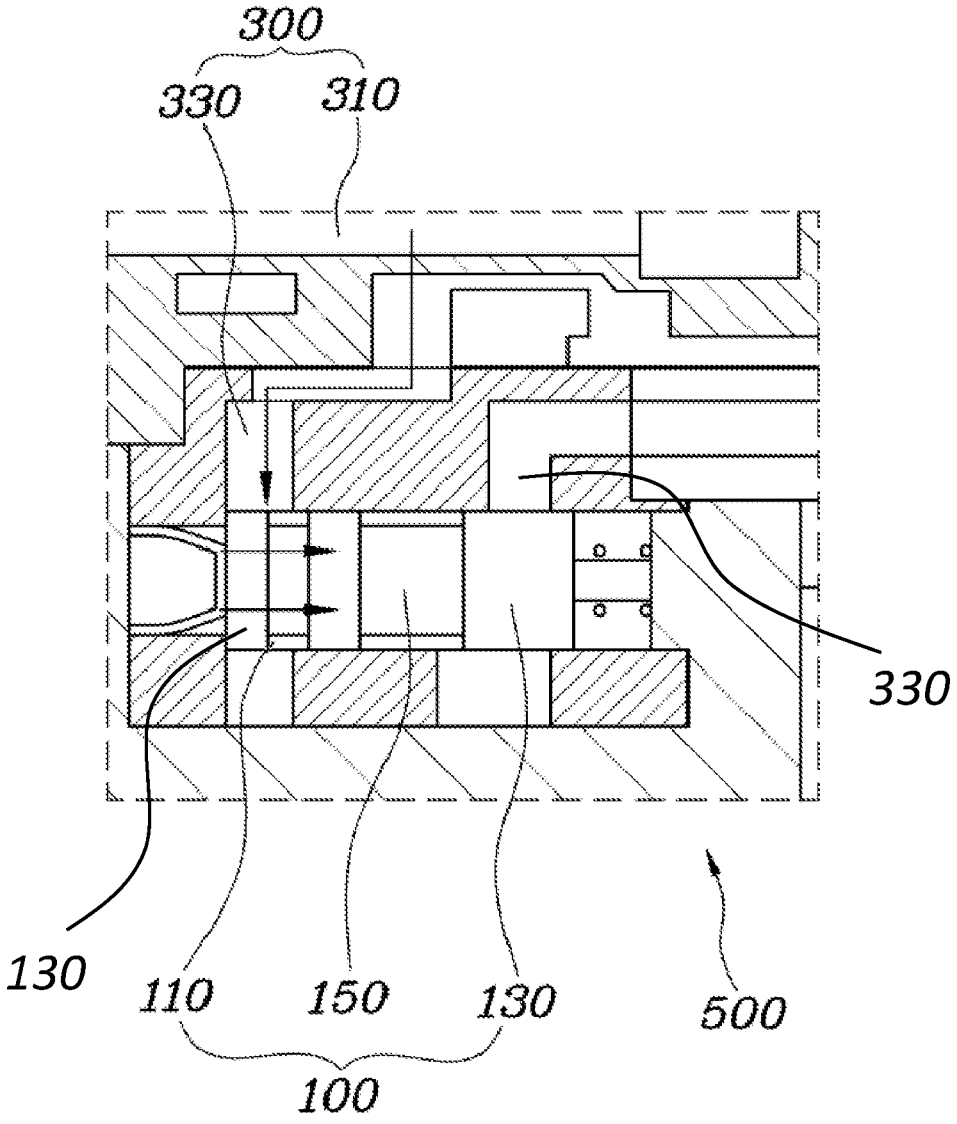

[FIG. 3]
PRIOR ART
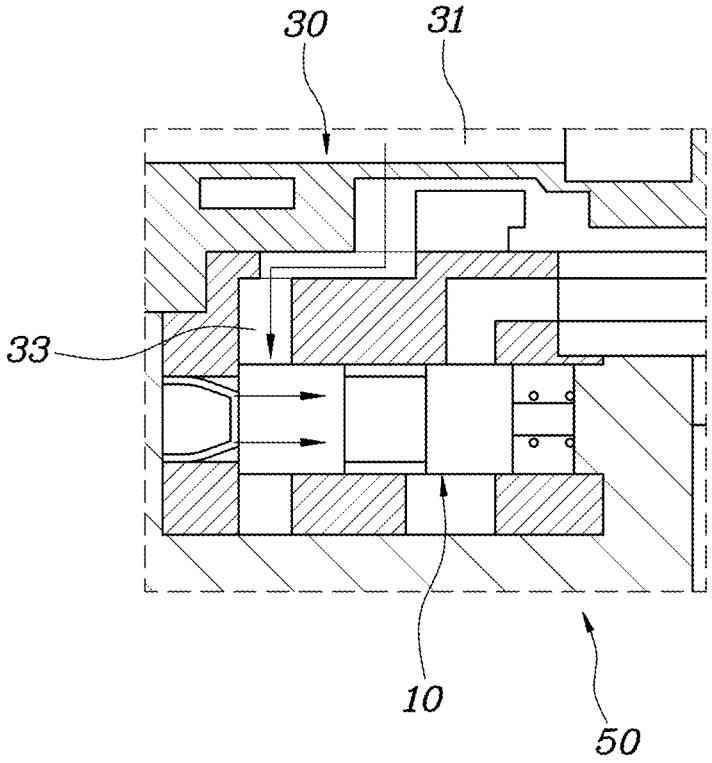

APPARATUS FOR OPENING AND CLOSING CHANNEL

CROSS REFERENCE TO RELATED APPLICATION

The present application claims priority to Korean Patent Application No. 10-2015-0091598, filed Jun. 26, 2015, which is incorporated herein by reference in its entirety.

FIELD

The present disclosure relates to an apparatus for opening and closing a channel that is disposed in a channel composed of a main channel and a sub-channel for flow of fluid.

BACKGROUND

The statements in this section merely provide background information related to the present disclosure and may not constitute prior art.

In general, a CVVT (Continuous Variable Valve Timing) is applied to a vehicle to reduce an exhaust gas and improve fuel efficiency and output. Recently, intermediate phase CVVT systems for removing limits in response and operation period of existing CVVT systems have been developed and those intermediate phase CVVTs control the position of a cam, not at the most advanced (intake) position and the most delayed (exhaust) position, but an intermediate position, so response is quick and the use period of a cam can be increased, so fuel efficiency is improved and an exhaust gas is reduced.

In intermediate phase CVVTs, a lock pin on the rotor is locked into a lock pin hole between an advancing chamber and a retarding chamber while the RPM of an engine is reduced, thereby preparing for later engine start. The action that the lock pin is automatically locked into the lock pin hole while the RPM of an engine reduces is called 'self-lock'.

The self-lock is a function that allows a CVVT system to mechanically return to an accurate position without specific adjustment so that operational stability of an engine can be maintained in periods where the CVVT system is not used, that is, when the engine is idling or is started.

However, when the valve timing reaches the most delayed position without returning to the intermediate phase, and an engine of a vehicle is idling, a surge tank may not be vacuumized and the internal pressure of the surge tank may increase up to the atmospheric pressure, so the performance of a brake using the vacuum of the surge tank may be deteriorated.

Further, when the valve timing reaches the most delayed position without returning to the intermediate phase, excessive overlap of valve timing may be generated between an intake valve and an exhaust valve, so the operational stability of the engine decreases and vibration of the engine increases, and in some cases, the engine stops.

That is, with a rotor and a lock pin positioned at the most advanced position or the most retarded position, when self-lock of a lock pin in an intermediate phase CVVT may not be automatically performed, negative pressure is not generated, so an engine is stopped or a brake system may not operate.

Accordingly, as shown in FIG. 3, a diverter valve 10 controlling a channel 30 is provided for self-lock of an intermediate phase CVVT 50 to open or close the channel 30, so a channel for supplying oil for operating the CVVT 50 is formed or hydraulic balance in an advancing chamber or a retarding chamber is maintained.

However, we have discovered that when the diverter valve is operated, side force is generated by oil pressure, so the diverter valve may not operate normally.

The foregoing is intended merely to aid in the understanding of the background of the present disclosure, and is not intended to mean that the foregoing is already known to those skilled in the art.

SUMMARY

Accordingly, the present disclosure proposes an apparatus for opening and closing a channel that removes a problem that a diverter valve is not operated, by preventing side force due to oil pressure when the diverter valve is operated.

According to one aspect of the present disclosure, there is provided an apparatus for opening and closing a channel that includes a diverter valve opening and closing the channel by sliding and having a pressure reducing portion at a side of the diverter valve to decrease side force due to hydraulic pressure.

The diverter valve may be composed of a head and a neck, the channel may be composed of a main channel and a sub-channel, and when the head corresponds to the sub-channel, the sub-channel may be closed and oil may not be supplied to the sub-channel from the main channel.

The pressure reducing portion may be an inwardly concave groove around the head.

The diverter valve may be disposed in a CVVT and opens or closes a channel for oil supplied to a lock pin.

The channel may be composed of a main channel and sub-channels and the diverter valve may be disposed in a sub-channel positioned symmetrically to the lock pin with the main channel therebetween.

According to one aspect of the present disclosure, there is provided an apparatus for opening and closing a channel including a diverter valve that is disposed in a sub-channel for supplying oil to a lock pin of a CVVT from a main channel, opens and closes the sub-channel by sliding, has a head and a neck, and has an inwardly concave groove around the head to reduce side force due to hydraulic pressure.

According to an apparatus for opening and closing a channel, it is disposed in a sub-channel for supplying oil to a lock pin of a CVVT from a main channel, can open and close the sub-channel by sliding, has a head and a neck, and has an inwardly concave groove around the head to reduce side force due to hydraulic pressure. Further, malfunction of a diverter valve may be caused by side force generated by hydraulic pressure when a diverter valve is opened in the related art, but in the present disclosure, side force is distributed by forming the pressure reducing portion at the head of the diverter valve, so it is possible to preclude malfunction of the diverter valve.

BRIEF DESCRIPTION OF THE DRAWINGS

The above and other objects, features and other advantages of the present disclosure will be more clearly understood from the following detailed description when taken in conjunction with the accompanying drawings, in which:

FIG. 1 is a view showing an intermediate phase CVVT equipped with an apparatus for opening and closing a channel according to an embodiment of the present disclosure;

FIG. 2 is a detailed view showing the part A of FIG. 1; and

FIG. 3 is a view showing in detail an apparatus for opening and closing a channel of the related art.

DETAILED DESCRIPTION

An apparatus for opening and closing a channel according to exemplary embodiments of the present disclosure is described hereafter with reference to the accompanying drawings.

FIG. 1 is a view showing an intermediate phase CVVT 500 equipped with an apparatus for opening and closing a channel according to an embodiment of the present disclosure; and FIG. 2 is a detailed view showing the part A of FIG. 1.

The present disclosure can be applied to all or parts of a system for opening or closing a channel, but in this specification, a diverter valve 100 for controlling a channel 300 is shown and described for achieving self-lock of a lock pin 700 of the CVVT 500. Accordingly, the diverter valve 100 is disposed in the CVVT 500 and forms the channel 300 by opening or closing with the channel 300 for oil supplied to the lock pin 700. In detail, as the channel 300 is opened or closed, it functions as a sub-part that forms the channel 300 for the oil supplied to the lock pin 700 or maintain hydraulic balance in an advancing chamber and a retarding chamber.

Accordingly, the apparatus for opening and closing a channel according to an embodiment of the present disclosure includes the diverter valve 100 that opens or closes the channel 300 by sliding and has a pressure reducing portion 110 at a side 112 to decrease side force due to hydraulic pressure. In particular, the channel 300 is composed of a main channel 310 and sub-channels 330 and oil supplied through the main channel 310 is supplied to the sub-channel 330 for the lock pin 700 and the sub-channel 330 for the diverter valve 100.

The diverter valve 100 is disposed symmetrically or parallel to the lock pin 700 with the main channel 310 therebetween, in detail, in the sub-channel 330 positioned symmetrically or parallel to the sub-channel of the oil supplied to the lock pin 700, so it forms the operation oil channel 300 of the CVVT 500 by connecting or disconnecting the channel 300 or maintain hydraulic balance of the advancing chamber and the retarding chamber.

The diverter valve 100 is composed of a head 130 and a neck 150, and as shown in FIG. 2, the number of heads (e.g. 130) may correspond to the number of the sub-channels (e.g. 330). Accordingly, in the present disclosure, two sub-channels 330 are provided, so two heads 130 may be provided. That is, as the heads 130 correspond to the sub-channels 330, they close the sub-channels 330 so that oil may not be supplied to the sub-channels 330 from the main channel 310.

The pressure reducing portion 110 is formed at a side of the diverter valve 100 and may be a concave groove formed around the head 130 of the diverter valve 100. The diverter valve 100 needs to slide in the channel 300 in order to open the sub-channels 330 and oil supplied from the main channel 310 is vertically (up and down on the page in FIG. 2) supplied to the sub-channels 330, so side force that laterally presses the head 130 is applied to the diverter valve 100 by hydraulic pressure.

In the related art, friction between a head and a sub-channel is increased by side force and a diverter valve does not slide, so a channel is not opened and poor opening of the diverter valve is caused in some cases. However, the pressure of the oil supplied to the sub-channels 330 is transmitted along the concave groove by the pressure reducing portion 110 formed at the head 130 of the diverter valve 100 and is uniformly applied in accordance with Pascal's principle, so side force is removed and the diverter valve 100 can normally operate. The contact area between the head 130 and the channel 300 is decreased by the pressure reducing portion 110, so poor opening of the diverter valve 100 due to side force can be precluded or reduced.

That is, sub-channels 330 supply oil to the lock pin 700 of the CVVT 500 from the main channel 310. The diverter valve can open or close the sub-channels 330 by sliding. Further, the head 130 and the neck 150 are provided and the inwardly concave groove is formed around the head 130. Accordingly, side force due to hydraulic pressure is reduced. Further, malfunction of a diverter valve may be caused by side force generated by hydraulic pressure when a diverter valve is opened in the related art, but in the present disclosure, side force is distributed by forming the pressure reducing portion 110 at the head of the diverter valve 100, so it is possible to preclude malfunction of the diverter valve 100.

Although embodiments of the present disclosure have been described for illustrative purposes, those skilled in the art will appreciate that various modifications, additions and substitutions are possible, without departing from the scope and spirit of the disclosure as disclosed in the accompanying claims.

What is claimed is:

1. An apparatus for opening and closing a channel, the apparatus comprising a diverter valve opening and closing the channel by sliding and having a pressure reducing portion at a side to decrease side force due to hydraulic pressure, wherein the diverter valve is disposed in a Continuous Variable Valve Timing System having the channel for oil and a lock pin, the diverter valve opening or closing the channel for oil supplied to the lock pin.

2. The apparatus of claim 1, wherein the diverter valve is composed of a head and a neck, the channel is composed of a main channel and a sub-channel, and when the head is disposed in the sub-channel, the sub-channel is closed and oil is not supplied to the sub-channel from the main channel.

3. The apparatus of claim 2, wherein the pressure reducing portion is an inwardly concave groove around the head.

4. The apparatus of claim 1, wherein the channel is composed of a main channel and sub-channels, and the diverter valve is disposed in one sub-channel positioned symmetrically to the lock pin with the main channel therebetween.

5. An apparatus for opening and closing a sub-channel for supplying oil to a lock pin of a Continuous Variable Valve Timing System from a main channel, the apparatus comprising a diverter valve disposed in the sub-channel for supplying oil to the lock pin, the diverter valve opening and closing the sub-channel by sliding, the diverter valve having a head and a neck, and having an inwardly concave groove around the head to reduce side force due to hydraulic pressure.

* * * * *